US006422439B1

(12) United States Patent
Kelliher et al.

(10) Patent No.: US 6,422,439 B1
(45) Date of Patent: Jul. 23, 2002

(54) COMBINATION BACKPACK AND HYDRATION PACK

(75) Inventors: Doug Kelliher, Milford; Tony Roina, Antrim; Brad Mina, Concord, all of NH (US)

(73) Assignee: Eastern Mountain Sports, Peterborough, NH (US)

( * ) Notice: Subject to any disclaimer, the term of this patent is extended or adjusted under 35 U.S.C. 154(b) by 0 days.

(21) Appl. No.: 09/779,784

(22) Filed: Feb. 8, 2001

(51) Int. Cl.[7] ..... A45F 3/04

(52) U.S. Cl. ..... 224/148.2; 224/148.5; 224/153; 224/583; 190/110

(58) Field of Search ..... 224/148.1, 148.2, 224/148.4, 148.7, 153, 148.5, 581, 582, 583, 627; 190/110

(56) References Cited

U.S. PATENT DOCUMENTS 4,506,769 A * 3/1985 Franco et al.
4,657,135 A * 4/1987 Kjose
4,673,117 A * 6/1987 Calton
4,953,674 A * 9/1990 Landes
5,743,447 A * 4/1998 McDermott
5,803,333 A * 9/1998 Fawcett
5,816,457 A * 10/1998 Croft
6,216,926 B1 * 4/2001 Pratt

* cited by examiner

*Primary Examiner*—Gregory M. Vidovich
(74) *Attorney, Agent, or Firm*—Cooper & Dunham LLP

(57) ABSTRACT

A combination backpack and hydration pack has a hydration pack portion and a standard backpack portion which are detachably connected to each other. The two portions can thus be used together as a hydration pack/standard backpack combination or separately as a pack solely for hydration purposes. The hydration pack portion has a bladder portion for holding liquid. The backpack portion is attachable to and circumscribes the hydration pack portion for providing additional carrying space.

6 Claims, 7 Drawing Sheets

COMBINATION BACKPACK AND HYDRATION PACK

FIELD OF THE INVENTION

The present invention relates to the field of backpacks, and, more particularly, to a two-in-one hydration pack for carrying liquid which has a hydration pack portion and an attachable backpack portion.

BACKGROUND OF THE INVENTION

Backpacks are extremely useful in many different settings. They are not only used for carrying everyday items, such as schoolbooks, but are also used for assisting those engaged in physical activities such as hiking, camping, biking, and skiing. These uses in particular call for special packs that are capable of easily carrying liquid for drinking, cooking, and washing. These special packs are called "hydration packs." Hydration packs are an alternative to a user having to carry, for example, the liquid in a thermos or water bottle placed in the backpack or on the user's person. A thermos or water bottle may be easily misplaced or damaged, and moreover it can be inconvenient for a user to access the thermos or water bottle while engaged in a physical activity.

Hydration packs are often constructed so that a bladder portion of the pack holds the liquid, which the user may access by way of a hose attached to the bladder portion. This configuration affords the user convenient access to the liquid. The bladder or reservoir is normally a polyethylene water storage unit that slides into a pouch that is typically sewn inside the rear of the packbag. The polyethylene bladder or reservoir cannot be used by itself as a backpack. Typically, then, the bladder portion is integrated with the pack; that is, the bladder portion is sewn to the pack or fastened in some other irreversible manner. This can be a drawback, however, in that the user of the pack is restricted to carrying the entire pack, even if the user knows he or she will be needing only the bladder portion of the pack on that particular day. This forces the user to carry unnecessary weight and bulk, and provides a pack that is more unwieldy than need be. Conversely, if the user happens to not need the bladder portion of the pack, he or she must nonetheless carry around the entire pack including the bladder portion.

One typical hydration pack is Hydrobak™, made by Camelbak®. Hydrobak™ is a pack which may be used only for hydration purposes; that is, the pack has no extra pockets for carrying additional items, and otherwise has only very limited carrying space in the form of an elastic cord located on the front of the pack. Therefore, the sole function of the pack is to carry water to keep the user hydrated.

Another typical hydration pack is Cloud Walker, also made by Camelbak®. Cloud Walker is a hydration pack which does have additional carrying space in the form of pockets. However, the bladder portion of the pack is integrated into the pack, and cannot be separated from the pack.

The drawbacks of the prior art as discussed above are overcome by the present invention.

SUMMARY OF THE INVENTION

It is an object of the present invention to solve the above mentioned problems by providing a hydration pack having a hydration pack portion and an attachable backpack portion. In this way, the user is able to easily attach or detach the backpack portion from the hydration pack portion which carries the bladder portion. Therefore, if the user wishes simply to use the smaller hydration pack portion, and not the entire pack, the user may simply detach the backpack portion and use the hydration pack portion separately.

The present invention therefore provides a so-called "two in one" hydration pack which has a hydration pack portion and a standard backpack portion which are detachably connected to each other. The two portions can be used together as a hydration pack/standard backpack combination or separately as a pack solely for hydration purposes. The hydration pack fits within the backpack. The invention allows the opportunity for a person to purchase one product that will serve two purposes or needs.

In summary, the present invention in one embodiment provides a two-in-one hydration pack. It includes a hydration pack portion, having a bladder portion for holding liquid, a pair of shoulder straps with male mating means disposed at a bottom end of each shoulder strap, and a first pair of female mating means disposed at a bottom of the hydration pack portion for receiving the male mating means of the shoulder straps when the hydration pack portion is used separately. It further includes a backpack portion attachable to and circumscribing the hydration pack portion for providing additional carrying space, the backpack portion having a pair of openings disposed at a top of the backpack portion for receiving each shoulder strap and having a second pair of female mating means disposed at a bottom of the backpack portion for receiving the male mating means of the shoulder straps to attach the backpack portion to the hydration pack portion. This permits the hydration pack portion and the backpack portion to be detachably connected to each other. The male and female components could also be reversed; it is simply necessary that the components be complementary.

The male mating means of each shoulder strap may comprise a male snap buckle, and the first and second pairs of female mating means may each comprise a pair of female snap buckles.

The bladder portion may comprise a bag for holding the liquid, with a hose extending from the bag to enable a user to access the liquid. A mouthpiece may be disposed at the end of the hose, the mouthpiece having a slit to allow the user to bite down and receive the liquid.

The present invention in another embodiment provides a two-in-one hydration pack. The hydration pack portion has a bladder compartment for holding liquid. The backpack portion is attachable to and circumscribes the hydration pack portion for providing additional carrying space. There are mating means for attaching the backpack portion to the hydration pack portion such that the backpack portion and the hydration pack portion are detachably connected to each other.

The hydration pack portion may further comprise a pair of shoulder straps, each shoulder strap having a bottom end detachably connected to one of the hydration pack portion and the backpack portion by way of the mating means.

The backpack portion may further comprise a pair of openings disposed at a top of the backpack portion for receiving the pair of shoulder straps when the bottom end of each shoulder strap is detachably connected to the backpack portion by way of the mating means.

The mating means may comprise male mating means disposed at the bottom end of each shoulder strap, a first pair of female mating means disposed at a bottom of the hydration pack portion, and a second pair of female mating means disposed at a bottom of the backpack portion.

DETAILED DESCRIPTION OF THE INVENTION

Figure 1:
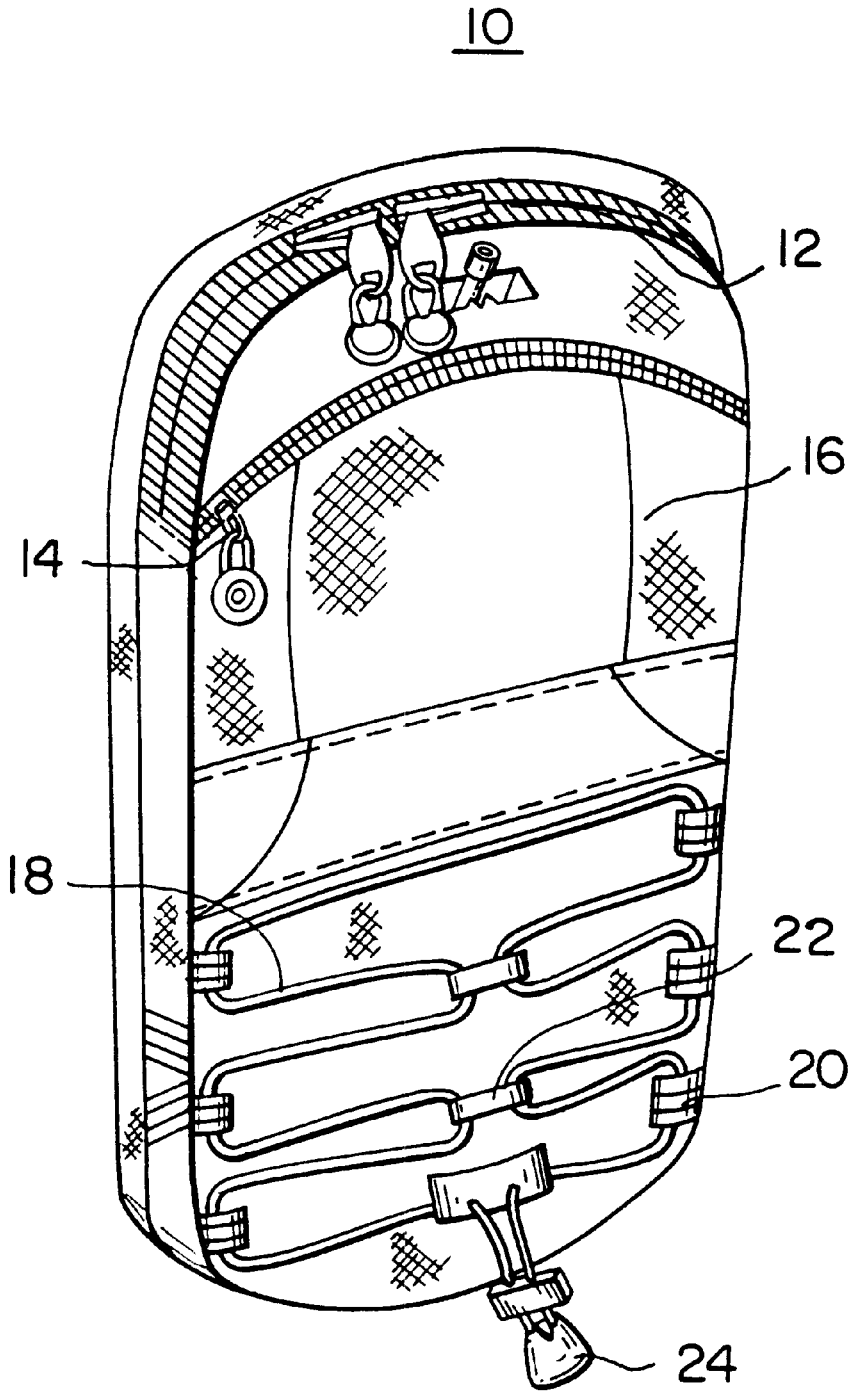
FIG. 1 illustrates a front view of a hydration pack portion configured to receive an attachable backpack portion, according to a preferred embodiment.

FIG. 1 illustrates a front view of a hydration pack portion 10 configured to fit within an attachable backpack portion, according to a preferred embodiment of the invention. The hydration pack portion 10 houses a bladder portion for holding the liquid (the bladder portion and hose assembly will be discussed below in relation to FIG. 7).

FIG. 1 shows a main compartment of the hydration pack portion 10 which houses the bladder portion, with a first zipper 12 for opening and closing the compartment. A second zipper 14 opens and closes a mesh pocket 16 used for storing small items. An elastic cord system provides additional storage. That system comprises an elastic cord 18, webbing loops 20, clip hooks 22, and an ellipse cord lock 24. As can be seen in FIG. 1, the hydration pack portion 10 has a number of extra pockets and space for carrying items other than the bladder portion. In this way, if the user opts to use only the hydration pack portion 10 (i.e., without the attachable backpack portion) then the user still has space for carrying additional items.

Figure 2:
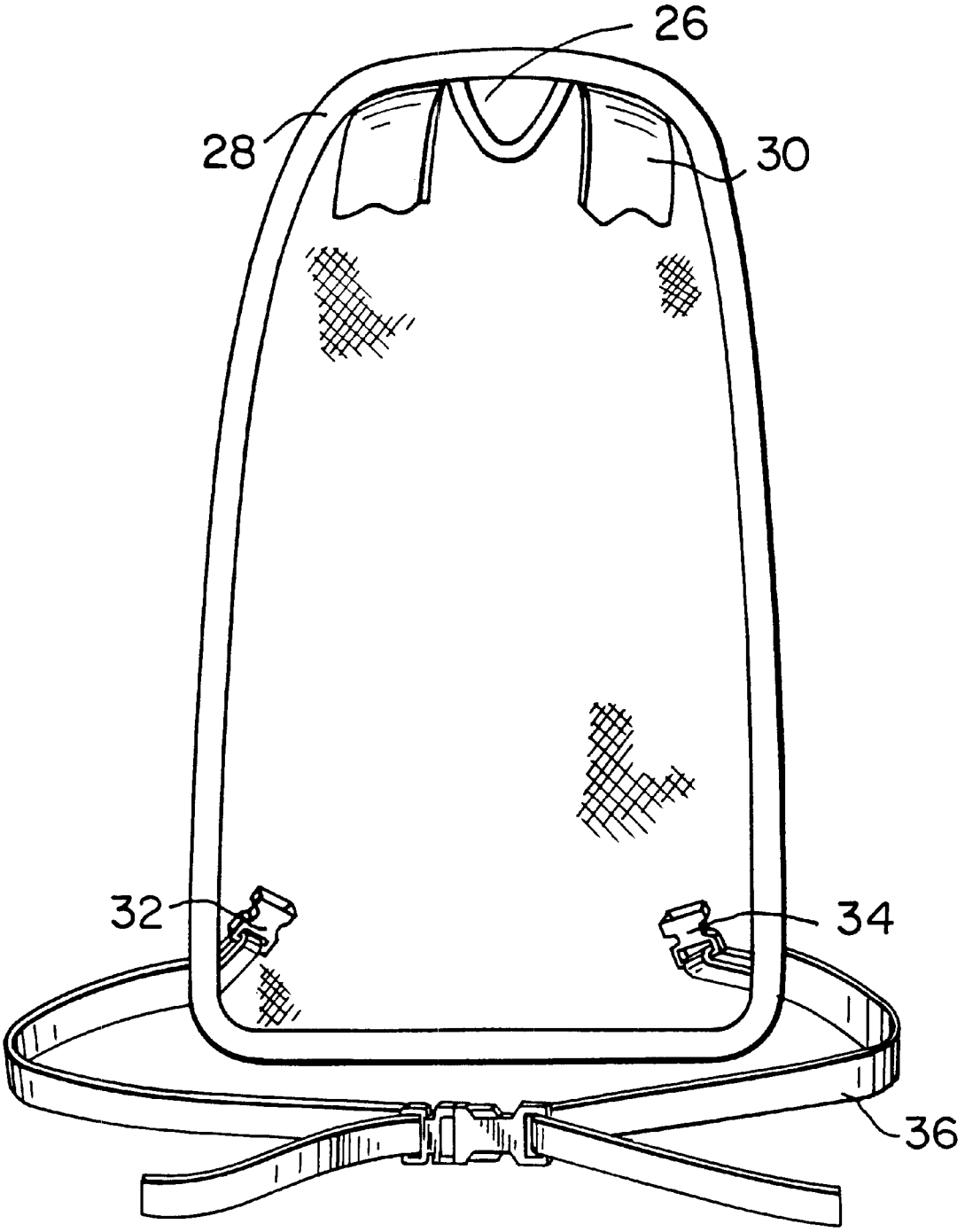
FIG. 2 illustrates a rear view of the embodiment of the hydration pack portion shown in FIG.

FIG. 2 illustrates a rear view of the embodiment of the hydration pack portion 10 shown in FIG. 1. An exit hole 26 permits a hydration hose (see FIG. 7) of the bladder portion to extend outwardly from the hydration pack. Shoulder straps 28, 30 (shown cut off in FIG. 2) allow the user to strap on the hydration pack portion 10 for carrying. The shoulder straps 28, 30 are attachable to the lower part of the hydration pack portion 10 using female type snap buckles 32, 34. A waist belt 36 may be placed around the user's waist for securing the hydration pack portion 10 around the user. Of course, other types of buckles and fasteners also may be used. And, of course, the male and female components of the buckles could be reversed.

Figure 3:
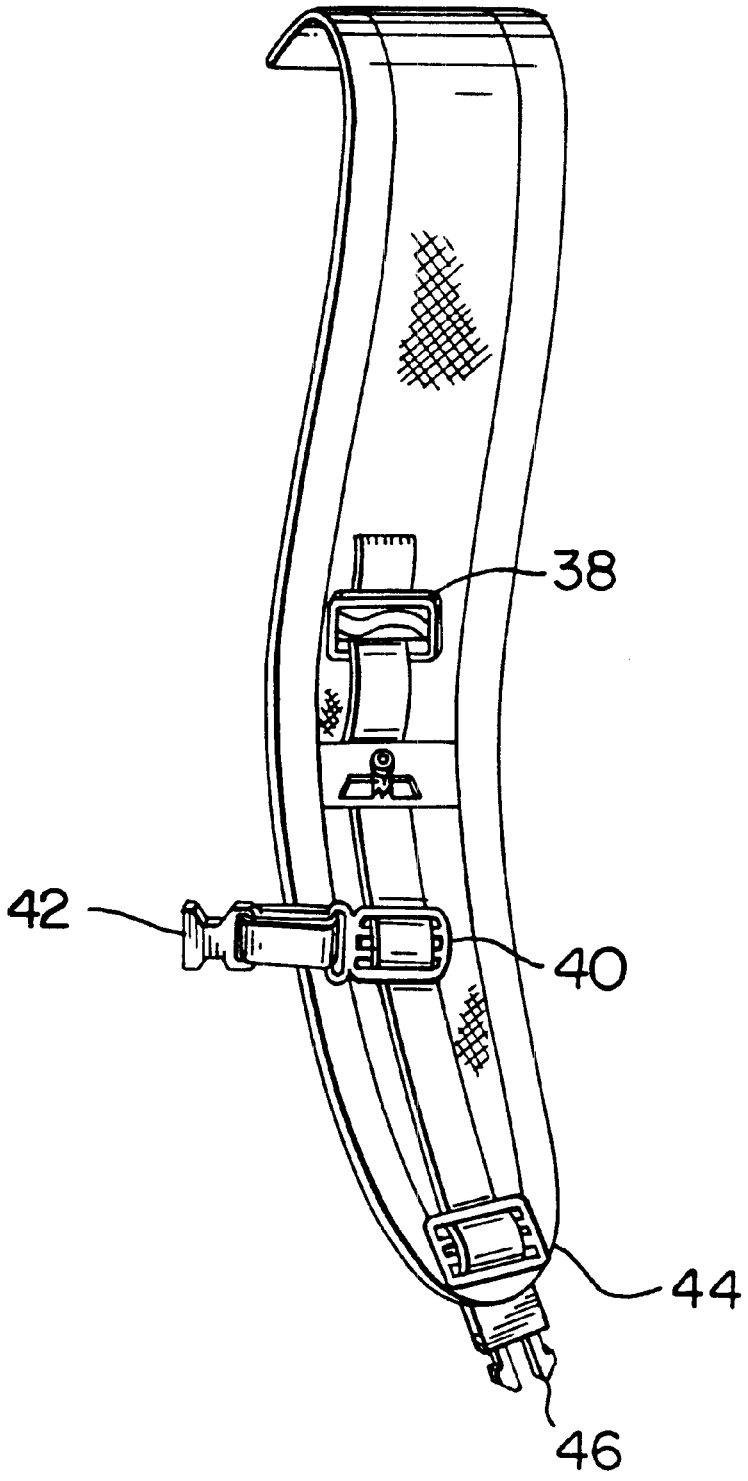
FIG. 3 illustrates a preferred embodiment of a shoulder strap of the hydration pack portion shown in FIGS. 1 and 2.

FIG. 3 illustrates a preferred embodiment of a shoulder strap 28 or 30 of the hydration pack portion 10. A hose clip 38 secures the hose onto the shoulder strap 28 or 30. An adjuster buckle 40, an snap buckle 42, and a tension lock 44 help secure the hydration pack portion 10. A male snap buckle 46 mates with the female airlock buckles 32, 34 of the hydration pack portion 10 so that the shoulder straps 28, 30 may be attached to the hydration pack portion 10. Other types of buckles and locks also may be used for this purpose.

Figure 4:
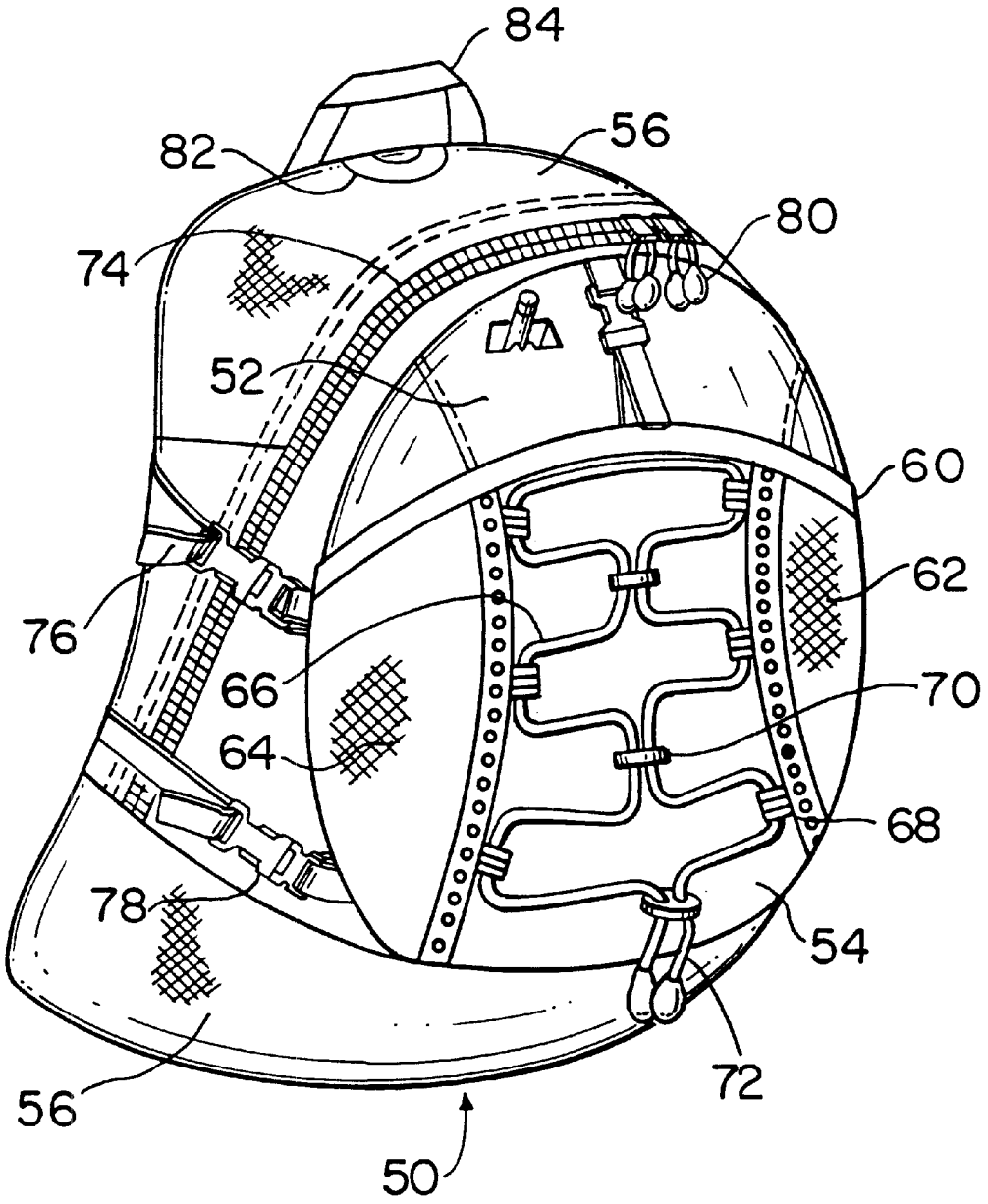
FIG. 4 illustrates a front view of the backpack portion which may be attached to and circumscribes the hydration pack portion, according to a preferred embodiment.

FIG. 4 illustrates a front view of the backpack portion 50 which may be attached to the hydration pack portion 10, according to a preferred embodiment. The backpack portion 50 has a main body 52, with a center panel 54, a side panel 56, and a bottom panel 58. The center panel 54 serves as a pocket for carrying smaller items. The center panel 54 has an elastic top edge 60, and the sides of the center panel 54 are mesh panels 62, 64. The hydration pack portion 10 fits easily within the backpack portion 50.

An elastic cord system similar to the elastic cord system of the hydration pack portion 10 is disposed across the center panel 54 to provide even more carrying space. The elastic cord system comprises an elastic cord 66, webbing loops 68, clip hooks 70, and an ellipse cord lock 72. Other types of storage systems also may be used. A zipper 74 opens and closes the main compartment. Side compression straps 76 operate in conjunction with airlock buckles 78 to help tighten the backpack portion 50. An snap buckle 80 helps close the pocket created by the center panel 54. An exit hole 82 for the bladder hose is located at the top of the pack 50. A haul loop 84 allows the user to haul or hang the backpack portion 50. Of course, other types of buckles and fasteners also may be used.

Figure 5:
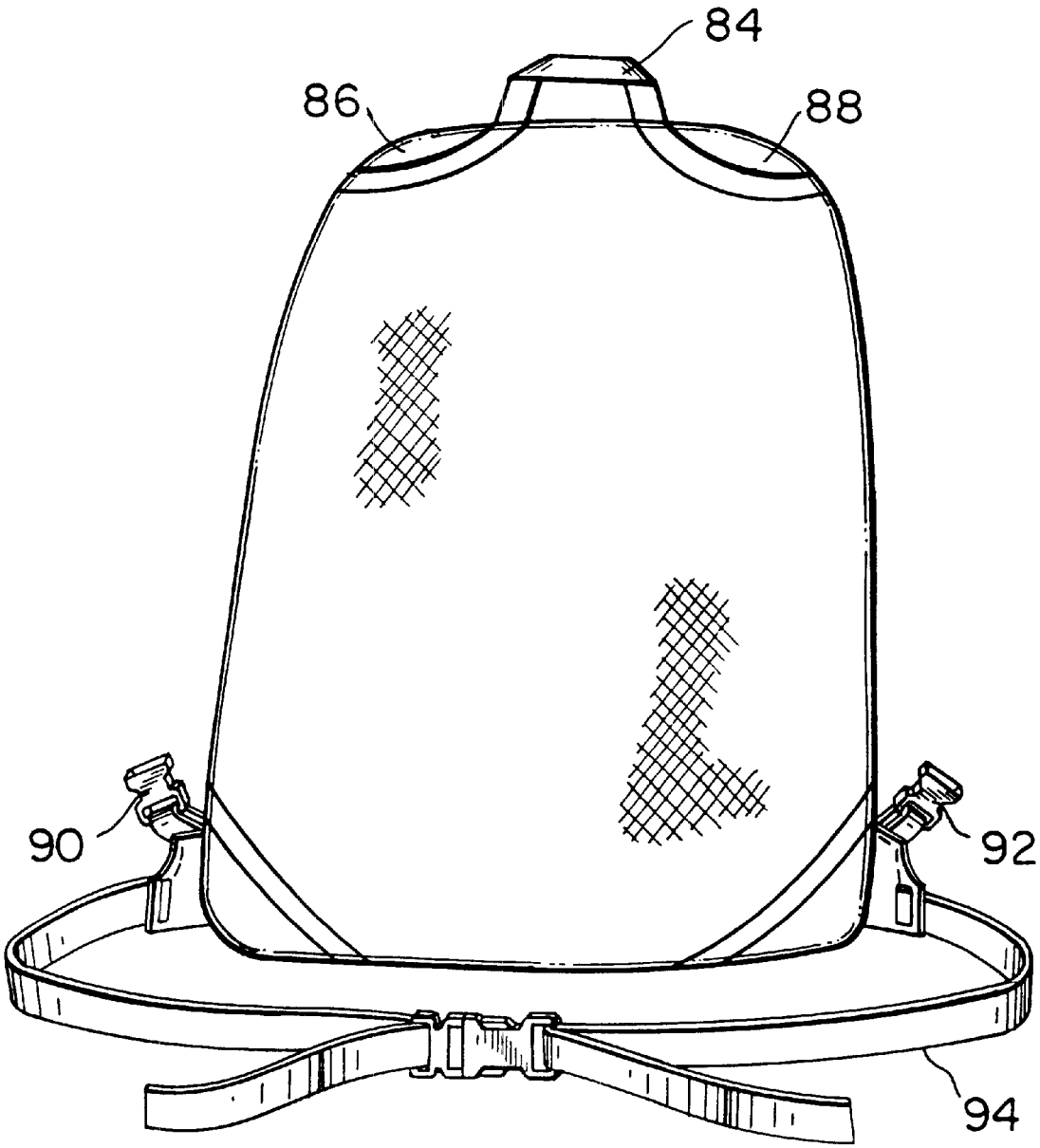
FIG. 5 illustrates a rear view of the backpack portion which may be attached to the hydration pack portion, according to the embodiment shown in FIG. 4.

FIG. 5 illustrates a rear view of the backpack portion 50 which may be attached to the hydration pack portion 10, according to the embodiment shown in FIG. 4. Slots or openings 86, 88 receive the shoulder straps 28, 30. Snap buckles 90, 92 attach the shoulder straps 28, 30 to the backpack portion 50 when the user wishes to utilize both the hydration pack portion 10 and the attachable backpack portion 50. A hip belt 94 fits around the user's waist for securing the backpack 50 to the user. Other buckles and straps could be used for this purpose.

Therefore, if the user wishes to use the hydration pack portion 10 separately (i.e., without attaching the backpack portion), then the user simply attaches the shoulder straps 28, 30 by way of the male snap buckle 46 on each shoulder strap 28, 30 to the airlock buckles 32, 34. On the other hand, if the user wishes to attach the backpack portion to the hydration pack portion 10 for additional carrying space, then the user detaches the shoulder straps 28, 30 from the snap buckles 32, 34 on the hydration pack portion 10, slides the shoulder straps through slots 86, 88 on the backpack portion 50, and fastens the shoulder straps 28, 30 to the snap buckles 90, 92 on the backpack portion 50.

In this way, the hydration pack portion 10 may be used either as its own pack, or may easily be received within the attachable backpack portion so that additional carrying space is provided. A unique feature of the invention, therefore, is that the shoulder straps 28, 30 are attachable either to the hydration pack portion 10 or to the backpack portion 50. Thus, a "two in one" pack is created whereby the user may attach or detach the backpack portion with ease as needed. Of course, using snap buckles as the attachment means is merely illustrative of one embodiment, and the present invention is not limited to any specific attachment means.

Figure 6:
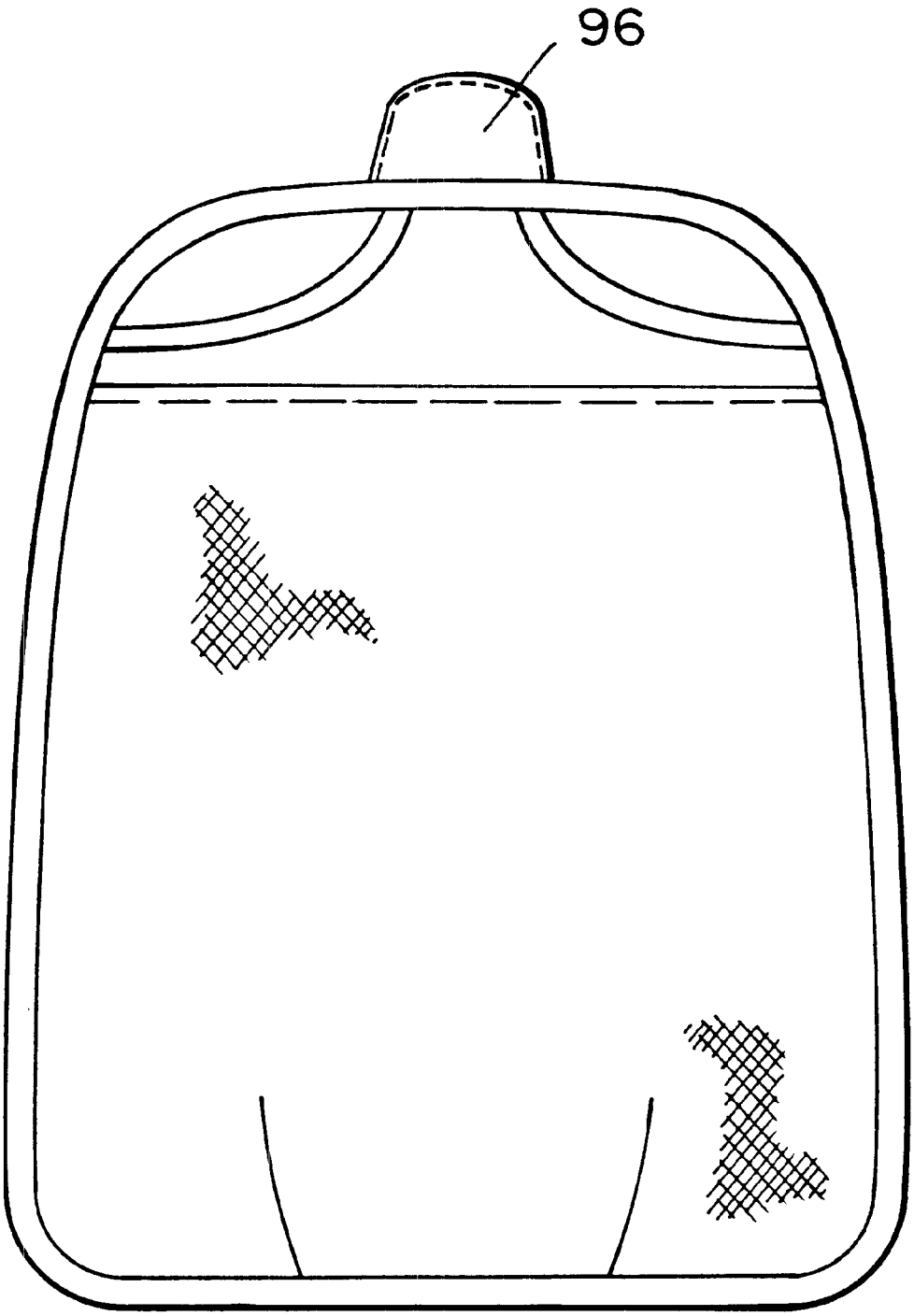
FIG. 6 illustrates an inner view of the backpack portion which may be attached to the hydration pack portion, according to the embodiment shown in FIG. 4.

FIG. 6 illustrates an inner view of the pockets and panels of the attachable backpack portion 50, according to the embodiment shown in FIG. 4. An exit hole cover 96 covers the exit hole 82 when the bladder hose is not disposed through the exit hole 82, i.e., when the backpack portion 50 is not attached to the hydration pack portion 10.

Figure 7:
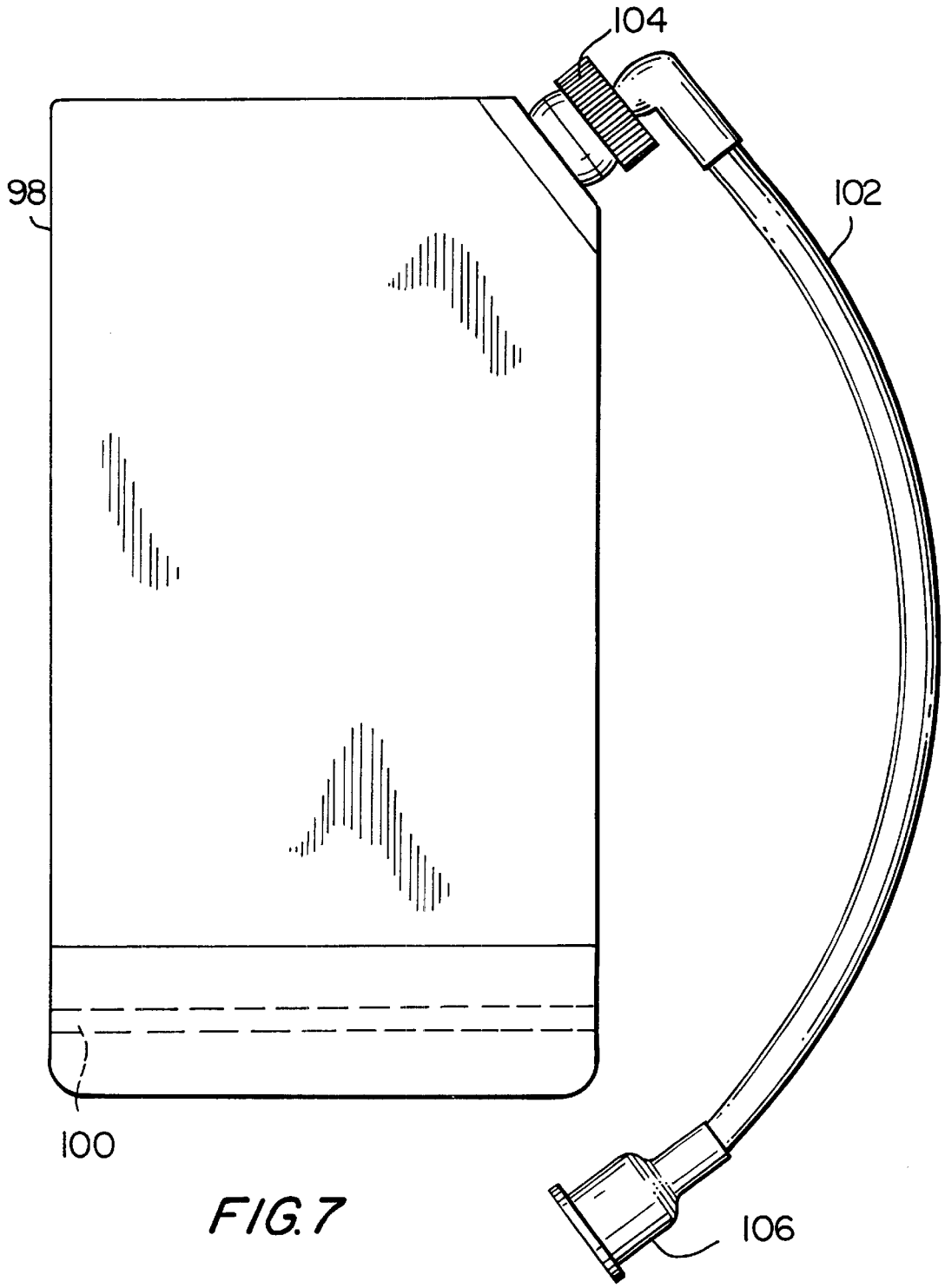
FIG. 7 illustrates a bladder portion and hose assembly according to one embodiment.

FIG. 7 illustrates a bladder portion and hose assembly according to one embodiment. A bag 98 holds the liquid, and is disposed inside the main compartment of the hydration pack portion 10. On one end of the bag 98 is a ziplock-type opening 100, to make the bag easier to clean and refill. On another end of the bag 98 is a hose assembly, wherein a hydration hose 102 is attached to a bottle cap 104 on one end and to a mouthpiece 106 on the other. The mouthpiece 106 has a slit in the front of it which allows the user to bite down to receive the liquid. Of course, the bag and hose assembly is merely illustrative of one embodiment of the bladder portion, and the present invention is not limited thereto.

Alternate embodiments of the invention can be imagined as well. For example, the shoulder straps of the hydration pack portion could be detachable on both ends, and could attach either to the backpack portion or to the hydration pack portion. In this way, if the user needs only the backpack portion and not the hydration pack portion, the user could simply detach the shoulder straps from the hydration pack portion and attach them to the backpack portion.

The above invention has been described with reference to specific embodiments, but a person skilled in the art could introduce many variations on these embodiments without departing from the spirit of the disclosure or from the scope of the appended claims. The embodiments are presented for the purpose of illustration only and should not be read as limiting the invention or its application. Therefore, the claims should be interpreted commensurate with the spirit and scope of the invention.

We claim:

1. A combination backpack and hydration pack, comprising:

a hydration pack portion, having a bladder portion for holding liquid, a pair of shoulder straps with mating members disposed at a bottom end of each shoulder strap, and a first pair of complementary mating members disposed at a bottom of the hydration pack portion for receiving the mating members of the shoulder straps when the hydration pack portion is used separately; and a backpack portion attachable to and circumscribing the hydration pack portion for providing additional carrying space, the backpack portion having a pair of openings disposed at a top of the backpack portion for receiving each shoulder strap and a second pair of complementary mating members disposed at a bottom of the backpack portion for receiving the mating members of the shoulder straps to attach the backpack portion to the hydration pack portion, so that the hydration pack portion and the backpack portion are detachably connected to each other.

2. The combination backpack and hydration pack as set forth in claim 1, wherein the mating members of each shoulder strap comprises a male snap buckle, and the first and second pairs of complementary mating members each comprise a pair of female snap buckles.

3. The combination backpack and hydration pack as set forth in claim 1, wherein the bladder portion comprises a bag for holding the liquid, and a hose extends from the bag to enable a user to drink the liquid.

4. The combination backpack and hydration pack as set forth in claim 3, further comprising a mouthpiece disposed at the end of the hose, the mouthpiece having a slit to allow the user to bite down and receive the liquid.

5. A two-in-one hydration pack, comprising:

a hydration pack portion having a bladder compartment for holding liquid;

a backpack portion attachable to and circumscribing the hydration pack portion for providing additional carrying space; and mating means for attaching the backpack portion to the hydration pack portion such that the backpack portion and the hydration pack portion are detachably connected to each other, wherein the hydration pack portion further comprises a pair of shoulder straps, each said shoulder strap having a bottom end selectively detachably connected to either of the hydration pack portion and the backpack portion by way of the mating means, wherein the backpack portion further comprises passage means disposed in an upstanding wall of the backpack portion for receiving the pair of shoulder strap when the bottom end of each shoulder strap is detachably connected to the backpack portion by way of the mating means.

6. The two-in-one hydration pack as set forth in claim 5, wherein the mating means comprises male mating means disposed at the bottom end of each shoulder strap, a first pair of female mating means disposed at a bottom of the hydration pack portion, and a second pair of female mating means disposed at a bottom of the backpack portion, said male mating means mateable with either of said first and second female mating means.

* * * * *